US012546033B2

(12) United States Patent
Zhang et al.

(10) Patent No.: US 12,546,033 B2
(45) Date of Patent: Feb. 10, 2026

(54) CARD CLOTHING WIRE, CARDING MACHINE AND METHOD FOR PRODUCING A NONWOVEN

(71) Applicant: Groz-Beckert KG, Albstadt (DE)

(72) Inventors: Yuning Zhang, Singapore (SG); Christian Kreller, Bisingen/Steinhofen (DE); Bernhard Bocht, Nordhorn (DE); Rainer Grossmann, Schwenningen (DE)

(73) Assignee: GROZ BECKERT KG, Albstadt (DE)

( * ) Notice: Subject to any disclaimer, the term of this patent is extended or adjusted under 35 U.S.C. 154(b) by 0 days.

(21) Appl. No.: 18/859,846

(22) PCT Filed: Apr. 20, 2023

(86) PCT No.: PCT/EP2023/060326
§ 371 (c)(1),
(2) Date: Oct. 24, 2024

(87) PCT Pub. No.: WO2023/208733
PCT Pub. Date: Nov. 2, 2023

(65) Prior Publication Data

US 2025/0290234 A1 Sep. 18, 2025

(30) Foreign Application Priority Data

Apr. 26, 2022 (EP) ..... 22170081

(51) Int. Cl.
*D01G 15/84* (2006.01)
*D01G 15/88* (2006.01)

(52) U.S. Cl.
CPC ..... *D01G 15/84* (2013.01); *D01G 15/88* (2013.01)

(58) Field of Classification Search
CPC ..... D01G 15/84; D01G 15/86; D01G 15/88
(Continued)

(56) References Cited

U.S. PATENT DOCUMENTS 4,606,095 A * 8/1986 Egerer ..... D01G 15/88 19/112
6,185,789 B1 * 2/2001 Hollingsworth ..... D01G 15/88 19/98

(Continued)

FOREIGN PATENT DOCUMENTS

CN 110938899 A 3/2020
CN 112981620 A * 6/2021 ..... D01G 15/84

(Continued)

OTHER PUBLICATIONS

Translation DE 4117715.*

(Continued)

*Primary Examiner* — Shaun R Hurley
(74) *Attorney, Agent, or Firm* — Fitch, Even, Tabin & Flannery, LLP

(57) ABSTRACT

A card clothing wire is disclosed, especially for a doffer or a worker of a carding machine, which provides a superior retention of fibers during a carding process and which can be universally used to produce nonwoven webs with an increased grammage or to produce nonwoven webs with a low grammage and an increased quality. In one form, the card clothing wire includes a tooth depth of less than 1.7 mm and an overhanging tip with an undercut.

17 Claims, 4 Drawing Sheets

(58) Field of Classification Search
USPC ..... 19/114
See application file for complete search history.

(56) References Cited

U.S. PATENT DOCUMENTS

| | | | | |
|---|---|---|---|---|
| 8,132,297 | B2 | 3/2012 | Breuer et al. | |
| 9,663,877 | B2 * | 5/2017 | Zhang | D01G 15/46 |
| 2014/0338154 | A1 * | 11/2014 | Zhang | D01G 15/88 19/99 |
| 2016/0122923 | A1 * | 5/2016 | Faggion | D04H 1/559 428/114 |
| 2017/0096751 | A1 * | 4/2017 | Zhang | D01G 15/88 |
| 2017/0137973 | A1 * | 5/2017 | Grob | D01G 15/26 |
| 2019/0119832 | A1 * | 4/2019 | Heißel | D01G 15/26 |

FOREIGN PATENT DOCUMENTS

| | | | | |
|---|---|---|---|---|
| DE | 4117715 | A1 * | 12/1992 | D01G 15/84 |
| EP | 2567010 | B1 | 9/2014 | |
| EP | 2756119 | B1 | 3/2016 | |
| WO | WO-9424348 | A1 * | 10/1994 | D01H 4/32 |
| WO | 00/26450 | A1 | 5/2000 | |
| WO | 2007022659 | A1 | 3/2007 | |
| WO | 2015110304 | A1 | 7/2015 | |

OTHER PUBLICATIONS

Translation CN 112981620.*

European Patent Office; Extended European Search Report in corresponding European Patent Application No. 22170081.8-1017, dated Sep. 30, 2022; 8 pages.

European Patent Office; Notification of Transmittal of The International Search Report and the Written Opinion of the International Searching Authority, or the Declaration in corresponding International Application No. PCT/ EP2023/060326, dated Jul. 4, 2023; 6 pages.

European Patent Office; European Search Report in corresponding PCT/EP2023/060326, dated Jul. 4, 2023; 3 pages.

Klein, W., "The Rieter Manual of Spinning", Rieter Machine Works Ltd., vol. 2—Blowroom & Carding, Wintherthur, Switzerland, 2014, 88 pages.

Russell, S.J., "Handbook of nonwovens", The Textile Institute, Cambridge, England, 2007; pertinent portions of carding listed in chapter 2, 16 pages.

European Patent Office, European Office Action in corresponding European Patent Application No. 22170081.8-1015, dated Apr. 7, 2025, 8 pages.

* cited by examiner

CARD CLOTHING WIRE, CARDING MACHINE AND METHOD FOR PRODUCING A NONWOVEN

CROSS REFERENCE TO RELATED APPLICATIONS

This application is the National Phase of International Application No. PCT/EP2023/060326, filed Apr. 20, 2023, which claims the benefit of European Patent Application Ser. No. 22/170,081.8, filed Apr. 26, 2022.

BACKGROUND

During a typical carding process, fiber tufts are fed towards the circumferential surface of a main cylinder, which is equipped with a card clothing wire and rotates with a constant velocity. The carding process, carding machines and card clothing wires are described in "The Rieter Manual of Spinning", Werner Klein, 2014 and in "Handbook of nonwovens", S. J. Russell, 2007. Card clothing wires usually have sharp teeth to handle the tufts. The teeth grip the tufts so that the circumferential movement of the main cylinder results in a transport of the tufts to a transfer point where the tufts are transferred to a doffer or a worker. The tufts can pass further rollers or machine parts of the carding machine on their way to the doffer or the worker. Although a carding machine can comprise these further rollers or machine parts, they aren't described in detail hereafter. The doffer has a cylindrical surface like the main cylinder. A card clothing wire is wound around this cylindrical surface. During their aforementioned transport the tufts are separated into single fibers or smaller tufts between the card clothing wire of the main cylinder and further flats or so called workers, which are arranged next to the circumferential surface of the main cylinder. Therefore, the workers move in the same direction like the circumferential movement of the main cylinder but rotate with a slower velocity than the main cylinder to separate the tufts into single fibers or smaller tufts. The fibers or tufts gripped by the worker usually are transferred to an accompanying stripper which re-deposits the fibers or smaller tufts back onto the main cylinder. Thus, fiber tufts get disentangled into single fibers or smaller tufts. These single fibers or smaller tufts often remain on the main cylinder for several revolutions before they are transferred to the doffer.

This transfer is performed by the teeth on the doffer. These teeth are also the teeth of a card clothing wire which is mounted on the doffer. Typically, the teeth of the doffer are higher than the teeth of the main cylinder. Moreover, the teeth of the doffer are sharp. The aforementioned two properties of the teeth of the doffer enable them to grip fibers on the circumferential surface of the main cylinder with a certain probability. Hence, the tooth depth of the teeth of the doffer wire is typically between 2.0 mm and 3.5 mm.

Another variable which is common to describe the geometry and the properties of a card clothing wire is the tooth population. It describes how many tips of the teeth of the card clothing wire are arranged in a predefined surface area of a carding roller (e.g. main cylinder, doffer or worker) once a card clothing wire is wound around this carding roller. Typically, the way to express the number of points (tips) per unit of surface area (hereafter referred to as "tooth population") in carding industry is in points per square inch (ppsi). The amount of points per unit of surface area can easily be converted to number of points per square millimeter by dividing by 645.16 (which is 25.4*25.4). It is known that the tooth population has an effect on the quality of a web which is produced with a carding machine. Usually, the higher the tooth population, the higher the quality up to a certain optimum.

At the point where the fibers are transferred to the doffer ("first transfer point"), the circumferential movement of the doffer has the same direction as the circumferential movement of the main cylinder (which requires that the doffer rotates in the opposite direction to the direction of rotation of the main cylinder). However, the circumferential movement of the doffer is slower than the respective movement of the main cylinder. The different velocity of the movement of these two rollers condenses the fibers and results in the formation of a web on the doffer. This web is then drawn from the doffer for subsequent treatment.

The above-described basic concept of carding has not changed since the $18^{th}$ century. During the last decades a lot of (further) effort was invested to increase the output of carding machines and the quality of the produced web. In this context, several new production methods have been applied:

One example is the production of nonwoven webs with a low grammage (weight per square meter) with new kinds of fiber material. However, the person skilled in the art still strives to increase the grammage and improve the quality of the web. The following patent publications disclose production methods and tools which have this purpose.

The document U.S. Pat. No. 8,132,297B2 shows a carding machine which increases the production rate or/and improves the quality of a nonwoven web which is produced with such a carding machine. For this purpose, the number of teeth per square inch on the doffer is at least 400 ppsi. One embodiment disclosed by this document is provided with teeth on a doffer with a tooth depth of less than 1.8 mm. Unfortunately, the document is silent about the effect of a tooth depth of less than 1.8 mm.

The documents WO0026450A1, EP2567010B1 and EP2756119B1 show card clothing wires for a doffer or a worker comprising a rib portion extending in a longitudinal direction of the card clothing wire and teeth longitudinally aligned on the rib portion which are meant to increase the output of carding machines by increasing the retention of fibers on the teeth of the card clothing wires. The teeth disclosed by the aforementioned documents have the following properties in common:

Each tooth comprises a tooth-back which bounds the tooth on a first side in the longitudinal direction. Furthermore a tooth-breast which represents the side in direct contact with fibers during carding limits the tooth on a second side in the longitudinal direction. A tip is formed between the tooth-back and the tooth-breast. The tooth-breast is divided into at least two segments: an edge-face segment which abuts on the tip and an undercut segment which is spaced apart from the tip and abuts on the edge-face segment. The edge-face and the undercut both form an angle with the rib portion, wherein the angle between the undercut and the rib portion is smaller than the angle between the edge-face and the rib portion. Thus, they form an overhanging tip. During the carding process the fibers are meant to be retained by these overhanging tips in order to enhance the efficiency of the fiber transfer from the main cylinder to the doffers or workers. This enhanced efficiency can be used to increase the output of the carding machine or to produce a nonwoven web with an increased thickness (which results in a higher grammage).

It is well known that the grammage of the produced nonwoven web also depends on the tooth depth of the teeth of the card clothing wire which is installed on the doffer—the higher the tooth depth, the higher the achievable grammage of the nonwoven web. This is a logical correlation because a higher tooth depth leads to more space between the teeth in which (more) fibers can be gripped for transfer (see "Handbook of nonwovens", S. J. Russell, 2007, Chapter 2.7.1). Thus, a nonwoven web with more fibers and a higher grammage can be produced. It is also known that the web quality (especially in low web weight applications) increases with the number of teeth per square inch (ppsi) of the card clothing wire on the doffer—up to a certain maximum. However, the maximum number of teeth per square inch depends on the tooth depth of the teeth: Doffers can only be provided with a relatively small number of long teeth (big tooth depth) per square inch.

SUMMARY

As a result, the person skilled in the art only has the choice between two extreme measures which exclude each other:

To increase the grammage by using doffers with a high tooth depth or to increase quality by using doffers with a high number of teeth per square inch (ppsi). A third alternative is (of course) any sort of tradeoff between the two aforementioned extreme alternatives.

The man skilled in the art is still not provided with a card clothing wire, a production method of nonwoven webs or a carding machine which enable him to produce both low and high grammage nonwoven webs with a good web quality so as to spare him the aforementioned choice or the respective tradeoff.

Therefore, one object of the present invention is to specify a card clothing wire especially for a doffer or a worker which provides a superior retention of fibers during a carding-process and which can be universally used in card clothing machines to produce nonwoven webs with an increased grammage or to produce nonwoven webs with a low grammage and an increased quality.

The problem is solved by a card clothing wire, a carding machine and a method as described herein. A card clothing wire for a doffer or a worker or a stripper of a carding machine comprises a rib portion which extends in a longitudinal direction of the card clothing wire. Teeth are arranged side by side in the longitudinal direction on the rib portion. At least one tooth is bounded by a tooth-back in the longitudinal direction on a first side and a tooth-breast on a second side. A tip is formed between the tooth-back and the tooth-breast at the highest point of the tooth in a height direction, which is perpendicular to the longitudinal direction. An edge-face which is a part of the tooth-breast abuts on the tip. The edge-face is in a functional contact to the fibers during the carding process when the fibers are transferred from the main cylinder to the doffer or the worker. Furthermore, an undercut is arranged on the tooth-breast in the height direction underneath the edge-face and extends relatively to the edge-face into the tooth towards the tooth-back. The angle between a tangent of the undercut and the longitudinal direction is called the undercut angle. The angle between a tangent of the edge-face and the longitudinal direction is called the tip angle. The edge-face and the undercut can have a substantially straight contour. In such a case the "tangent" of this straight contour is meant to be interpreted as an imaginary straight extension of the contour. To increase the retention of the fibers at the undercut, the undercut angle is smaller than the tip angle. Thus, an overhanging tip is formed between the tooth-breast and the tooth-back which increases the retention of fibers on the edge-face compared to card clothing wires without such an overhanging tip. A tooth-root connects the tooth-breast and the tooth-back of subsequent teeth at their lowest point in the height direction. Additionally, the card clothing wire comprises a tooth depth which is the distance in the height direction between the tip and the lowest point of this tooth-root and which is smaller than 1.7 mm but preferably smaller than 1.5 mm. Advantageously, the tooth depth is even smaller than 1.3 mm. State of the art card clothing wires on doffers usually have a tooth depth between 2.0 mm and 3.5 mm. Tests have shown that it is possible to increase the grammage of the produced nonwoven web by reducing the tooth depth of the teeth of the card clothing wire if the teeth also comprise the aforementioned features. For example by using a card clothing wire with an undercut and a tooth height smaller than 1.7 mm on the doffer, the grammage of the produced web can be increased by up to 50% (or even more) compared to a web which is produced with a conventional card clothing wire with an undercut and a tooth depth between 2.0 mm and 3.5 mm. This fact is quite surprising because usually the person skilled in the art would try to increase the tooth depth of the teeth to increase the grammage of the produced web. Thus, reducing the tooth depth on a card clothing wire to increase the grammage of a produced nonwoven web breaks with common technical rules. Accordingly, it is a surprising synergetic effect between the undercut and the reduced tooth depth which leads to an increased grammage.

In a carding machine, which comprises a main cylinder and at least one doffer and/or worker, a card clothing wire comprising the aforementioned properties can advantageously be wound around the doffer and/or the worker. Such a carding machine can run a carding-process for producing a nonwoven web wherein fibers are transferred from the main cylinder to the doffer and/or the worker and/or the stripper by the teeth of the card clothing wire which have a tooth depth of less than 1.7 mm but preferably less than 1.5 mm. In comparison to the state of the art carding-processes and carding machines, the grammage of a nonwoven web produced with such a carding machine and carding-process can be increased.

The applicant conducted an experiment with a carding machine by producing a nonwoven web to examine the effect of using a card clothing wire with a reduced tooth depth on a doffer. In this experiment two different configurations of the card clothing wire on the doffer are tested. Each of the tested card clothing wires comprise teeth with overhanging tips which comprise the aforementioned properties. The card clothing wire on the main cylinder is a conventional card clothing wire without an undercut. Further specifications of the card clothing wires wound around the main cylinder and the doffer of the carding machine during this experiment are disclosed in the following table. The card clothing wire referred to as "doffer A" in the table below has typical specifications known from the state of the art, whereas the card clothing wire referred to as "doffer B" has specifications comprising the aforementioned advantageous properties. The fibers processed during the experiment were both polyester and viscose fibers. Any parameter of the card clothing machine other than the card clothing wire on the doffer was not varied during the experiment. Surprisingly, the grammage of the produced nonwoven web increases by 53% by using the "doffer B" compared to the nonwoven web produced by using the "doffer A", although the tooth depth of "doffer A" is much larger than the tooth depth of "doffer B".

| | Main cylinder | Doffer A | Doffer B |
|---|---|---|---|
| Population [ppsi] | 423 | 323 | 432 |
| Tooth depth [mm] | 1.32 | 2.4 | 1.4 |
| Wire height [mm] | 3.3 | 4.0 | 2.8 |
| Tip angle [degree] | 75 | 50 | 50 |
| Undercut angle [degree] | — | 12 | 12 |
| Front angle [degree] | 75 | 50 | 50 |

Card clothing wires have a wire height which is the distance between the tip of the teeth and the lowest point of the rib portion referring to the height direction. In a preferred embodiment of a card clothing wire the wire height is less than 3 mm but preferably less than 2.8 mm. Such a card clothing wire can be used to produce nonwoven webs with an increased grammage. Furthermore, card clothing wires with such a low wire height can be produced with a minimum amount of materials which reduces the manufacturing costs.

The teeth of a card clothing wire comprise a front angle which is the angle between a tangent of the tooth-breast and the longitudinal direction. Advantageously, the front angle is 45° to 65° but preferably 50° to 60°. Thus, the retention of fibers at the teeth increases.

Advantageously, the undercut of the card clothing wire comprises a linear portion which is substantially parallel to the longitudinal direction. Thus, a sharper undercut is formed and the retention of fibers at the teeth increases.

In a preferred embodiment the teeth of the card clothing wire comprise a curved portion which is a part of the tooth-breast and abuts on the undercut at an end of the undercut which is spaced apart from the edge-face. Said curved section has a constant radius. Thus, the card clothing wire offers an excellent fiber retention and has superior strength and fatigue resistance over the prior art.

In another preferred embodiment the teeth of the card clothing wire comprise a back angle which is the angle between a tangent of the tooth-back and the longitudinal direction, wherein the undercut angle is greater than the back angle. Thus, the retention of fibers at the teeth increases and manufacturing costs can be decreased by forming the teeth of the card clothing wire with rotary punching.

Advantageously, at least two undercuts are arranged on the tooth-breast. Preferably at least three undercuts are arranged on the tooth-breast. The retention of fibers at the teeth can be further increased by providing a tooth-breast with these multiple undercuts.

A card clothing wire comprising any combination of the aforementioned properties can advantageously be used on the doffer and/or the worker and/or the stripper in a carding machine and in a carding-process. In a preferred embodiment the main cylinder of this carding machine has a tooth population of 250 to 630 ppsi (points per square inch). Such a carding machine is suitable for increasing the grammage and/or the quality when producing a nonwoven web.

Advantageously, the doffer of the carding machine has a tooth population of 230 to 500 ppsi (points per square inch) but preferably 260 to 440 ppsi (points per square inch). Thus, the grammage and/or the quality of a nonwoven web produced with such a carding machine can be increased.

The quality of the produced nonwoven web can further be improved by a carding machine with a main cylinder comprising a card clothing wire which has a tooth depth of at least 0.7 mm but preferably at least 0.8 mm. In a more preferred embodiment the card clothing wire of the main cylinder has a tooth depth of at least 0.86 mm.

A carding machine comprising any combination of the aforementioned properties is advantageous to produce nonwoven webs with an increased grammage or to produce nonwoven webs with a low grammage and an increased quality.

A carding machine comprising a combination of the aforementioned properties can operate a carding-process for producing a nonwoven web wherein fibers are transferred from the main cylinder to the doffer and/or the worker and/or the stripper by the teeth of a card clothing wire. Advantageously, a nonwoven with a grammage of less than 5 gsm (grams per square meter) but preferably less than 4 gsm is produced with the carding-process. These are quite low grammages. Usually, the quality of the nonwoven web is reduced when producing a nonwoven web with such a low grammage with a state of the art card clothing wire. Surprisingly, the quality of a nonwoven web with such a low grammage can be increased by using a card clothing wire comprising a combination of the aforementioned properties.

The carding-process can be further improved when the grammage of the produced nonwoven web is increased by decreasing the tooth depth of the card clothing wire of the doffer. Although this is contrary to the common technical knowledge about carding, the applicant provides evidence of this effect with the aforementioned experiment.

Advantageously, glass fibers, carbon fibers, static charged fibers or hybrid fibers are transferred from the main cylinder to the doffer during the carding-process. Thereby, hybrid fibers comprise at least two different materials (e.g. two different polymers). In a preferred embodiment the hybrid fibers comprise polypropylene and polyethylene. All these types of fibers usually tend to wrap around the teeth of a card clothing wire of a doffer and are thus hindered to be released from the doffer again, which is disadvantageous referring to the quality of the produced nonwoven web. In a carding-process comprising a combination of the aforementioned properties this defect is eliminated. Though, the quality of the produced nonwoven web can be increased.

BRIEF DESCRIPTION OF THE DRAWINGS

Preferred embodiments of the invention are described hereafter.

DETAILED DESCRIPTION

Figure 1:
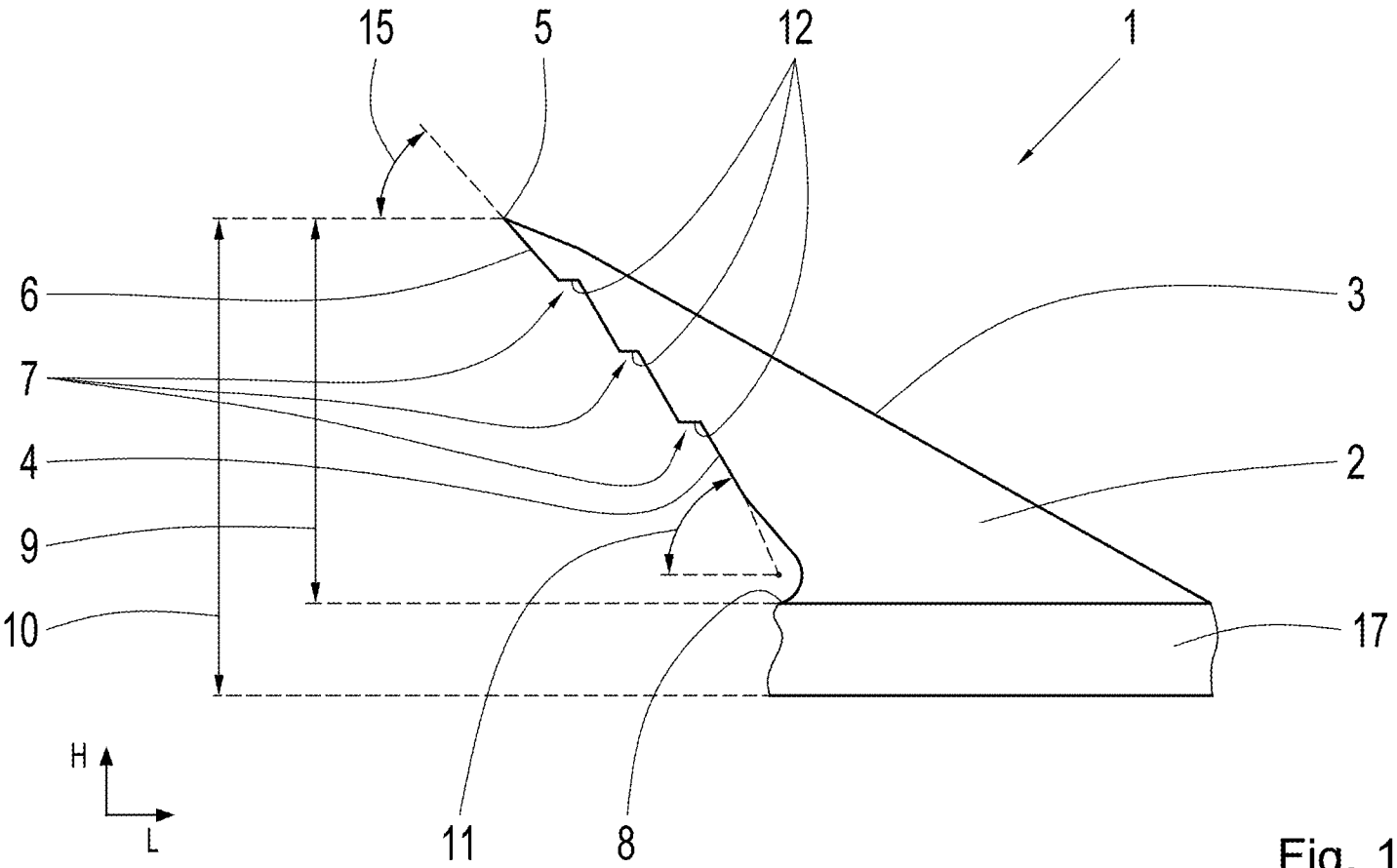
FIG. 1 shows a first embodiment of a card clothing wire (1).

FIG. 1 shows a first embodiment of a card clothing wire 1. The card clothing wire 1 comprises teeth 2 which are longitudinally arranged side by side on a rib portion 17 which extends in a longitudinal direction L of the card clothing wire 1. In FIG. 1 only a section of the card clothing wire 1 with one tooth 2 is shown. The tooth 2 is bounded by a tooth-back 3 on a first side and a tooth-breast 4 on a second side in the longitudinal direction L. A tip 5 is formed between the tooth-back 3 and the tooth-breast 4 at the highest point of the tooth 2 in a height direction H which is perpendicular to the longitudinal direction L. Such card clothing wires are circumferentially wound around the rollers (e.g. main cylinder, doffer, worker) of a carding machine during a carding-process. Due to a rotational movement of these rollers the teeth 2 of the card clothing wire 1 are moved in a circumferential direction of the rollers to grip fibers during the carding-process. Thereby, the tooth-breast 4 is in a functional contact with the fibers to retain them on the teeth 2. A tangent of the tooth-breast 4 is arranged in an angle to the longitudinal direction which is defined as the front angle 11. The front angle 11 preferably is 25 degrees to 45 degrees. To improve the retention of the fibers, the tooth-breast 4 comprises an edge-face 6 which abuts on the tip 5 and an undercut 7 which abuts on the edge-face 6. The undercut 7 is spaced apart from the tip 5 and extends relatively to the edge-face 6 towards the tooth-back 3. The card clothing wire 1 furthermore comprises two additional undercuts 7. Each additional undercut 7 further increases the retention of fibers at the teeth 2. The edge-face 6 and the undercuts 7 are arranged in different angles to the longitudinal direction L. The angle of the edge-face 6 hereafter is referred to as tip angle 15, whereas the angle of the undercuts 7 is referred to as undercut angle 16. To form an overhanging tip the undercut angle 16 is smaller than the tip angle 15. The undercuts 7 of the first embodiment of the card clothing wire 1 shown in FIG. 1 comprises linear portions 12 with an undercut angle 16 of zero degrees, which means the linear portions 12 are substantially parallel to the longitudinal direction L. Thus, the retention of fibers at the undercuts 7 is improved. Subsequent teeth 2 of the card clothing wire 1 are connected with each other at their lowest point referring to the height direction H by a tooth-root 8. The distance in the height direction H between the tooth-root 8 and the tip 5 is defined as the tooth depth 9. In a preferred embodiment of the invention the tooth depth 9 is smaller than 1.7 mm but preferably smaller than 1.5 mm. Experiments, which were conducted by the applicant, surprisingly showed that the grammage of a nonwoven web produced with such a card clothing wire on a doffer of a carding machine can be increased. The total height of the card clothing wire is called wire height 10 and can be defined as the sum of the tooth depth 9 and the height of the rib portion 17. In a preferred embodiment of the invention the wire height is less than 3 mm.

Figure 2:
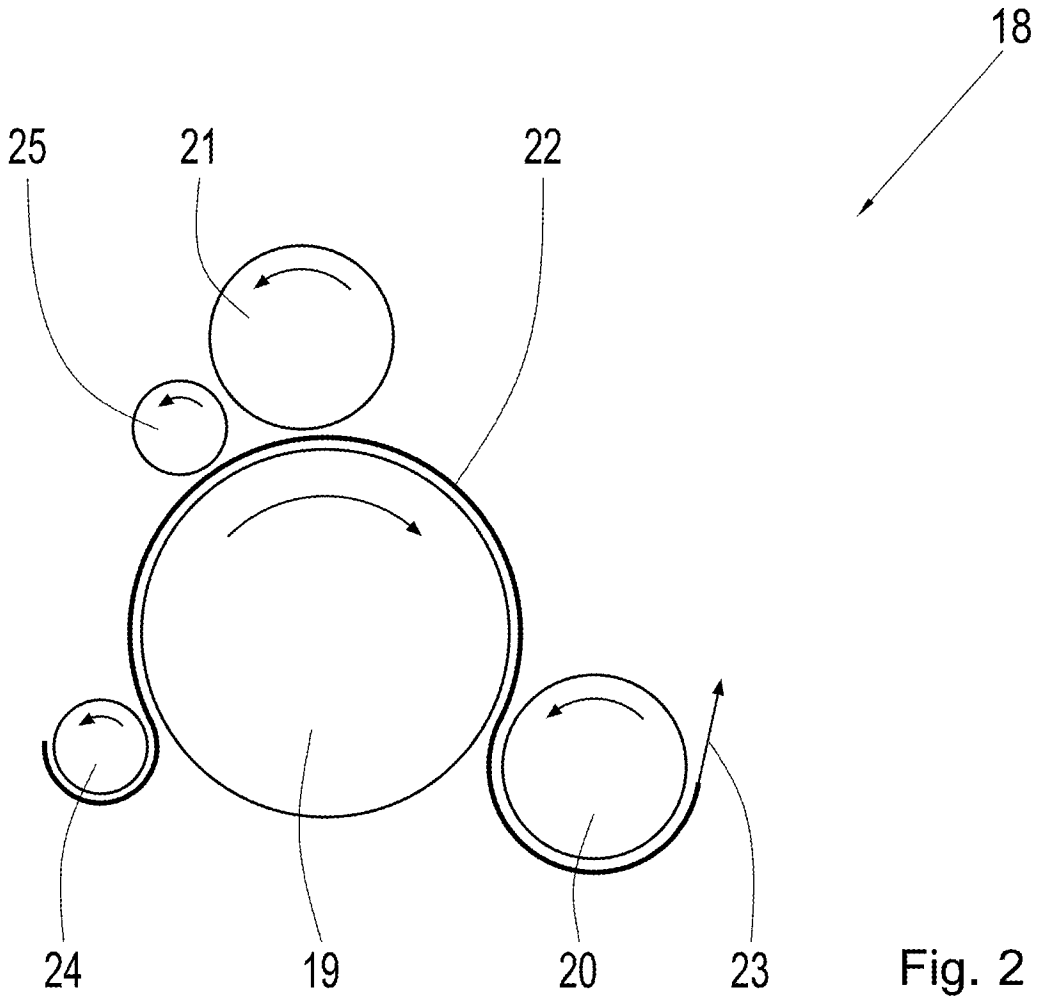
FIG. 2 shows a carding machine (18) and the transfer path (22) of fibers in this carding machine (18).

FIG. 2 shows a schematic view of a carding machine 18 and the transfer path 22 on which fibers are transported in such a carding machine 18 during a carding-process. Only the main cylinder 19, a worker 21, a doffer 20, a stripper 25 and a licker-in 24 which are rollers or cylinders of the carding machine 18 are shown. Each of them is equipped with a card clothing wire. Advantageously, at least the doffer 20 and/or the worker 21 are equipped with a card clothing wire 1 shown in FIG. 1. A main cylinder with a tooth population of 270 to 470 ppsi and/or a doffer 20 with a tooth population of 250 to 370 ppsi can contribute to further improvements. In a preferred embodiment the main cylinder 19 comprises a card clothing wire 1 with a tooth depth 9 of at least 0.85 mm to process fibers efficiently. When glass fibers, carbon fibers, static charged fibers or hybrid fibers are processed, the fibers usually tend to wrap around the teeth 2 of the card clothing wire 1 of the doffer 20 and thus clog the doffer 20. A carding machine 18 with the aforementioned properties avoids this effect. Typically, carding machines 18 can comprise further machine parts which are not shown in this figure because these machine parts are unnecessary to define and understand the subject matter claimed with this patent application. A description of how fibers are transferred in the carding machine 18 follows: the transfer path 22 is the path on which fibers are transported in a carding machine. The transfer direction 23, in which the fibers are transported on the transfer path 22, is shown with an arrow at the end of the transfer path 22. In the carding machine 18 fiber tufts are fed towards a licker-in 24 and get gripped by the teeth 2 of the card clothing wire which is wound around the licker-in 24. The licker-in 24 transports the fiber tufts on a transfer path 22 in a circumferential direction of the licker-in 24 towards the main cylinder 19. At a point where the licker-in 24 is close to the main cylinder 19, the teeth 2 of the card clothing wire of the main cylinder 19 grip the fibers to transfer them from the licker-in 24 to the main cylinder 19. At this point the licker-in 24 and the main cylinder 19 both rotate in the same circumferential direction, which is indicated by the arrows shown in FIG. 2. A main function of the carding machine is to disentangle these fiber tufts into single fibers. The main cylinder 19 subsequently transports the fibers on the transfer path 22 in a circumferential direction of the main cylinder 19 towards one or more workers 21. In FIG. 2 only one worker 21 is shown. The worker 21 is arranged close to the main cylinder 19. At the nearest point of the circumferential surface of the worker 21 to the circumferential surface of the main cylinder 19 the worker 21 can grip fibers of a fiber tuft to disentangle the fiber tuft. The fibers gripped by the worker 21 are transferred to an accompanying stripper 25 which re-deposits the disentangled fibers back onto the main cylinder 19. Thus, fiber tufts get disentangled into single fibers. In practice, most fibers and fiber tufts stay on the main cylinder 19 for several revolutions and are thus recycled several times on the same worker 21 and stripper 25 to improve the disentanglement of the fibers. After disentangling the fiber tufts the main cylinder 19 transports the single fibers towards a doffer 20. At a point where the teeth 2 of the doffer 20 can grip the single fibers, the fibers are transferred to the doffer 20. At this point the doffer 20 condenses the fibers and combines them into a web because of its substantially lower peripheral speed relative to the main cylinder 19. The doffer 20 transports the web in a circumferential direction to a point where the web is drawn off from the doffer 20 for subsequent treatment.

Figure 3:
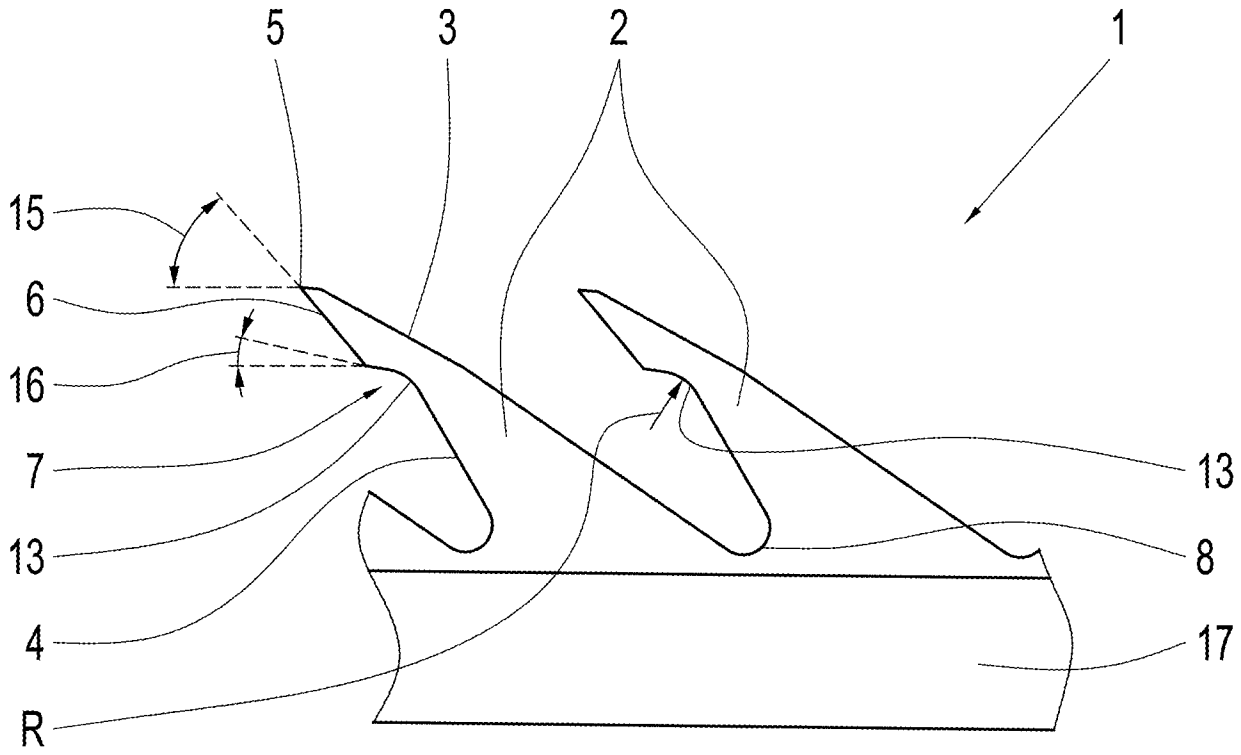
FIG. 3 shows a second embodiment of a card clothing wire (1).

FIG. 3 shows a section of a second embodiment of a card clothing wire 1 which is suitable to be used on a doffer 20 or a worker 21 of a carding machine 18. The card closing wire 1 comprises two teeth 2 arranged on a rib portion 17 in this section. The teeth 2 have the following properties in common with the tooth 2 shown in FIG. 1:

- a tooth-back 3, a tooth-breast 4, a tip 5, an edge-face 6, an undercut 7, a tooth-root 8 and an undercut angle 16 which is smaller than a tip angle 15.

Furthermore, the tooth-breast 4 of each of the teeth 2 comprises a curved portion 13 which abuts on an end of the undercut 7 which is spaced apart from the edge-face 6. The curved portion has a constant radius R. Thus, these teeth 2 offer an increased retention of fibers during the carding-process.

Figure 4:
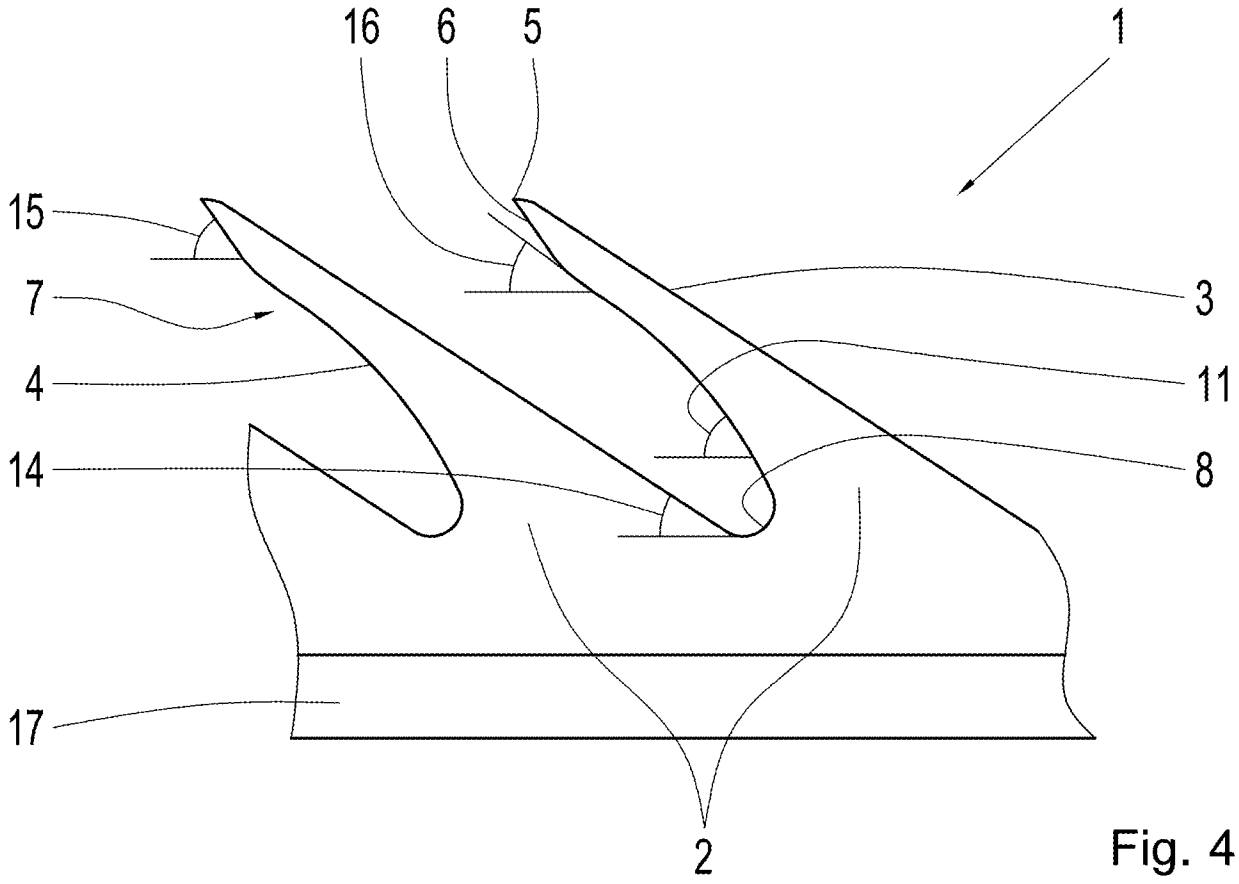
FIG. 4 shows a third embodiment of a card clothing wire (1).

FIG. 4 shows a section of a third embodiment of a card clothing wire 1 which is suitable to be used on a doffer 20 or a worker 21 of a carding machine 18. The card closing wire 1 comprises two teeth 2 arranged on a rib portion 17 in this section. The teeth 2 have the following properties in common with the tooth 2 shown in FIG. 1:

- a tooth-back 3, a tooth-breast 4, a tip 5, an edge-face 6, an undercut 7, a tooth-root 8 and an undercut angle 16 smaller than a tip angle 15.

Furthermore, in this embodiment the back angle 14 which is the angle between a tangent of the tooth-back 3 and the longitudinal direction L is smaller than the undercut angle 16. Thus, the teeth 2 can be produced by rotary punching to reduce manufacturing costs.

| List of numerals | |
|---|---|
| 1 | Card clothing wire |
| 2 | Tooth |
| 3 | Tooth-back |
| 4 | Tooth-breast |
| 5 | Tip |
| 6 | Edge-face |
| 7 | Undercut |
| 8 | Tooth-root |
| 9 | Tooth depth |
| 10 | Wire height |
| 11 | Front angle |
| 12 | Linear portion |
| 13 | Curved portion |
| 14 | Back angle |
| 15 | Tip angle |
| 16 | Undercut angle |
| 17 | Rib portion |
| 18 | Carding machine |
| 19 | Main cylinder |
| 20 | Doffer |
| 21 | Worker |
| 22 | Transfer path of fibers |
| 23 | Direction of fiber transfer |
| 24 | Licker-in |
| 25 | Stripper |
| L | Longitudinal direction |
| H | Height direction |
| R | Radius of the curved section (13) |

The invention claimed is:

1. A card clothing wire (1) for a doffer (20), a worker (21), or a stripper (25) of a carding machine (18), the card clothing wire comprising:

a rib portion which extends in a longitudinal direction (L) of the card clothing wire (1);

a plurality of teeth (2) which are arranged side by side in the longitudinal direction (L) on the rib portion (17);

wherein at least one tooth (2) of the plurality of teeth is bounded by a tooth-back (3) on a first side in the longitudinal direction (L);

wherein the at least one tooth (2) is bounded by a tooth-breast (4) on a second side in the longitudinal direction (L);

a tip (5) formed between the tooth-back (3) and the tooth-breast (4) at a highest point of the tooth (2) in a height direction (H), wherein the height direction (H) is perpendicular to the longitudinal direction (L);

an edge-face (6) of the tooth-breast (4) that abuts the tip (5);

an undercut (7) arranged on the tooth-breast (4) underneath the edge-face (6) in the height direction, wherein the undercut (7) abuts the edge-face (6) and extends towards the tooth-back (3) relative to the edge-face (6);

a tip angle (15) formed between a tangent of the edge-face (6) and the longitudinal direction (L); and an undercut angle (16) formed between a tangent of the undercut (7) and the longitudinal direction (L);

wherein the undercut angle (16) is smaller than the tip angle (15);

a tooth-root (8) which connects the tooth-breast (4) and the tooth-back (3) of adjacent teeth (2) of the plurality of teeth (2) at their lowest point in the height direction (H);

wherein a tooth depth (9) measured in the height direction (H) between the tip (5) and a lowest point of the tooth-root (8) is smaller than 1.7 mm;

wherein a curved portion (13) of the tooth-breast (4) abuts the undercut (7) at an end of the undercut (7) which is spaced apart from the edge-face (6), wherein the curved portion has a constant radius of curvature (R).

2. The card clothing wire (1) according to claim 1, wherein the at least one tooth (2) has a wire height (10) of less than 3 mm, wherein the wire height (10) is measured in the height direction (H) between the tip (5) and the lowest point of the rib portion (17).

3. The card clothing wire (1) according to claim 1, wherein a front angle (11) measured between a tangent of the tooth-breast (4) and the longitudinal direction (L) is from 45° to 65°.

4. The card clothing wire (1) according to claim 1, wherein the undercut (7) comprises a linear portion (12) which is parallel to the longitudinal direction (L).

5. The card clothing wire (1) according to claim 1, wherein a back angle (14) measured between a tangent of the tooth-back (3) and the longitudinal direction (L) is less than the undercut angle (16).

6. The card clothing wire (1) according to claim 1, wherein the tooth-breast (4) comprises at least two undercuts (7).

7. The card clothing wire of claim 1, wherein the tooth depth (9) is smaller than 1.5 mm.

8. A carding machine (18) comprising the card clothing wire of claim 1, the carding machine comprising:

a main cylinder (19); and at least one of: a doffer (20), a worker (21), and a stripper (25) comprising the card clothing wire (1).

9. The carding machine (18) according to claim 8, wherein the main cylinder (19) comprises a tooth population of 270 to 550 points per square inch (ppsi).

10. The carding machine (18) according to claim 8, wherein the doffer (20) comprises a tooth population of 230 to 460 points per square inch (ppsi).

11. The carding machine (18) according to claim 8, wherein:

the main cylinder (19) comprises a card clothing wire having a tooth depth (9) of at least 0.7 mm.

12. The carding machine (18) of claim 11, wherein the card clothing wire has a tooth depth (9) of at least 0.8 mm.

13. A carding process for producing a nonwoven using the card clothing wire (1) of claim 1, the process comprising:

transferring fibers from a main cylinder (19) to at least one of a doffer (20), a worker (21), and a stripper (25) comprising the card clothing wire (1) to produce a nonwoven web;

wherein the fibers are transferred from the main cylinder (19) to the at least one of a doffer (20), a worker (21), and a stripper (25) comprising the card clothing wire by the teeth (2) of the card clothing wire (1) which have a tooth depth (9) of less than 1.7 mm.

14. The carding process according to claim 13, wherein transferring fibers from the main cylinder (19) to the at least one of a doffer (20), a worker (21), and a stripper (25) comprising the card clothing wire (1) produces a nonwoven with a grammage of less than 5 gsm (grams per square meter).

15. The carding process of claim 14, wherein transferring fibers from the main cylinder (19) to the at least one of a doffer (20), a worker (21), and a stripper (25) comprising the card clothing wire (1) produces a nonwoven with a grammage of less than 4 gsm (grams per square meter).

16. The carding process according to claim 13, wherein the fibers are transferred from the main cylinder (19) to the doffer (20) and the fibers comprise at least one of glass fibers, carbon fibers, static charged fibers, and hybrid fibers, wherein the hybrid fibers comprise at least two different materials.

17. The carding process of claim 13, wherein the teeth (2) of the card clothing wire (1) have a tooth depth (9) of less than 1.5 mm.

* * * * *